US008992254B2

(12) United States Patent
Banakis et al.

(10) Patent No.: US 8,992,254 B2
(45) Date of Patent: Mar. 31, 2015

(54) INTEGRATED SHIELDED CONNECTOR

(75) Inventors: Emanuel G. Banakis, Naperville, IL (US); Jerry D. Kachlic, Glen Ellyn, IL (US)

(73) Assignee: Molex Incorporated, Lisle, IL (US)

( * ) Notice: Subject to any disclaimer, the term of this patent is extended or adjusted under 35 U.S.C. 154(b) by 192 days.

(21) Appl. No.: 13/503,913

(22) PCT Filed: Oct. 27, 2010

(86) PCT No.: PCT/US2010/054281

§ 371 (c)(1),
(2), (4) Date: Jun. 27, 2012

(87) PCT Pub. No.: WO2011/056649

PCT Pub. Date: May 12, 2011

(65) Prior Publication Data

US 2012/0282809 A1 Nov. 8, 2012

Related U.S. Application Data

(60) Provisional application No. 61/255,366, filed on Oct. 27, 2009.

(51) Int. Cl.
*H01R 12/72* (2011.01)
*H01R 13/6585* (2011.01)

(52) U.S. Cl.
CPC ..... *H01R 12/724* (2013.01); *H01R 12/721* (2013.01); *H01R 13/6585* (2013.01)
USPC ..... 439/607.23

(58) Field of Classification Search
USPC ..... 439/607.4–607.7, 607.23, 607.25
See application file for complete search history.

(56) References Cited

U.S. PATENT DOCUMENTS

| | | | | |
|---|---|---|---|---|
| 6,086,420 | A | 7/2000 | Wu | |
| 6,780,055 | B2 * | 8/2004 | Shinoura et al. | 439/607.55 |
| 6,939,172 | B2 * | 9/2005 | Lu | 439/607.2 |
| 8,864,523 | B2 * | 10/2014 | Banakis et al. | 439/607.25 |
| 2002/0048992 | A1 * | 4/2002 | Wang et al. | 439/607 |
| 2003/0228799 | A1 | 12/2003 | Machado et al. | |
| 2006/0003632 | A1 * | 1/2006 | Long | 439/608 |

FOREIGN PATENT DOCUMENTS

| | | |
|---|---|---|
| JP | 2004-087486 | 3/2004 |
| WO | WO 2008/077133 A1 | 6/2008 |

OTHER PUBLICATIONS

International Search Report for PCT/US2010/054281.

* cited by examiner

*Primary Examiner* — Tho D Ta
(74) *Attorney, Agent, or Firm* — Stephen L. Sheldon

(57) ABSTRACT

A connector includes a housing positioned in a cage. A vertical wall is positioned around the housing and is soldered to a printed circuit board that is supporting the connector. The vertical wall includes a plurality of fingers that are configured to engage the cage. The fingers are positioned at intervals such that the distance between the fingers acts to control the frequencies of EMI that emit from the connector.

12 Claims, 7 Drawing Sheets

INTEGRATED SHIELDED CONNECTOR

This application is a national phase of PCT Application No. PCT/US10/054,281, filed Oct. 27, 2010, which in turn claims priority to U.S. Provisional App. No. 61/255,366, filed Oct. 27, 2009, and which is incorporated herein by reference in its entirety.

BACKGROUND OF THE INVENTION

1. Field of the Invention

The present invention relates to the field of connectors, more specifically to the field of high data rate I/O connectors.

2. Description of Related Art

Shielded connectors have been used in external applications (e.g., applications in which the connector acts as an interface to devices external to the system in which the connector is mounted) so as to provide acceptable electromagnetic interference (EMI) and signal performance. One issue that has been noted is that as the frequencies of signaling increase, additional power is often required in order for the system to function over a similar distance. Furthermore, the use of higher signaling frequencies tends to increase the sensitivity of the connector to external noises in those higher frequencies. In addition, the terminals in the connector tend to act as radiators and emit EMI. Consequentially, the effect of increasing power and signal frequencies tends to negatively affect EMI performance. As EMI generally needs to be carefully controlled, shielded connectors face a number of challenging issues. Thus, certain individuals would appreciate improvements in shielded connector designs.

BRIEF SUMMARY OF THE INVENTION

A connector with a housing positioned in a shield includes a vertical wall that engages the shield on three sides of housing. The vertical wall may include a lip that can be surface mounted directly on a circuit board and coupled to a ground plane thereof so as to provide a substantially continuous or a pattern of coupling to the ground plane. The vertical wall may be provided via a single component or some number of separate components. If the connector includes a shield plate on a front face of the housing, a vertical wall can further engage a shield wall on a fourth side of the housing. The vertical wall can include a plurality of fingers spaced predetermined distance apart.

BRIEF DESCRIPTION OF THE DRAWINGS

The present invention is illustrated by way of example and not limited in the accompanying figures in which like reference numerals indicate similar elements and in which.

DETAILED DESCRIPTION OF THE INVENTION

Figure 1:
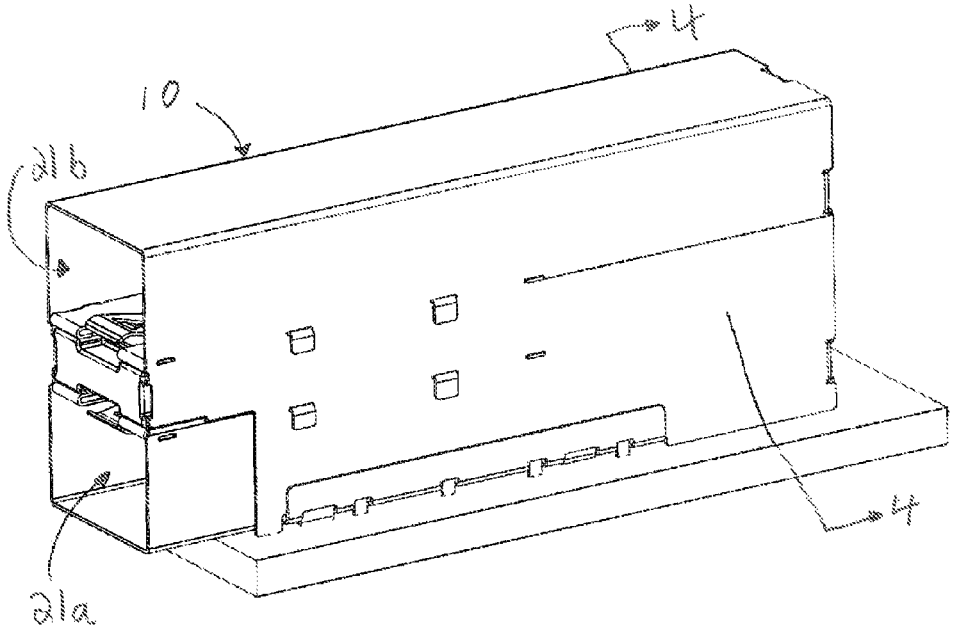
FIG. 1 illustrates a perspective view embodiment of a receptacle assembly.
Figure 2:
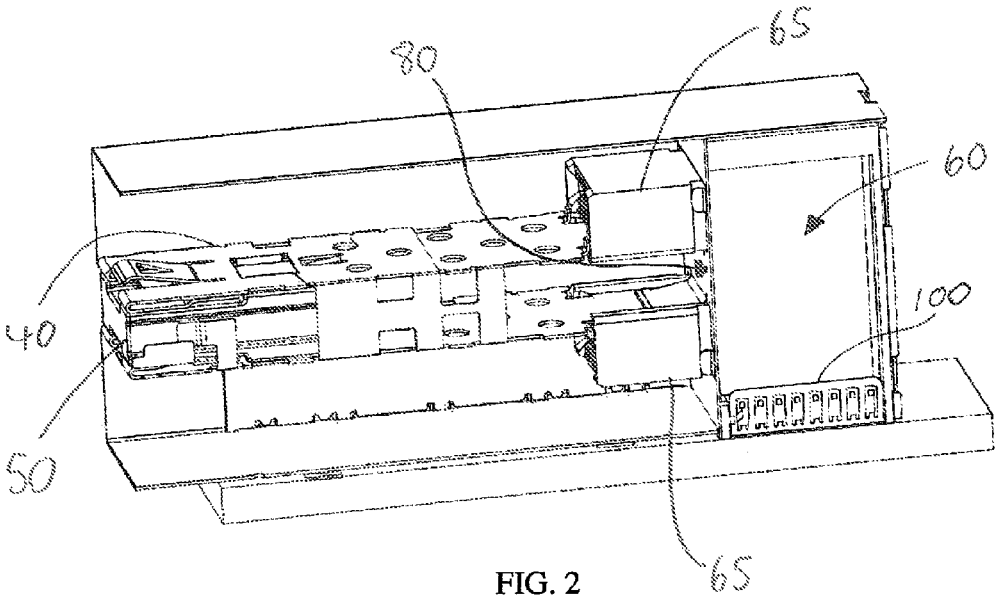
FIG. 2 illustrates a perspective view the cross-section of the embodiment depicted in FIG. 1.
Figure 3:
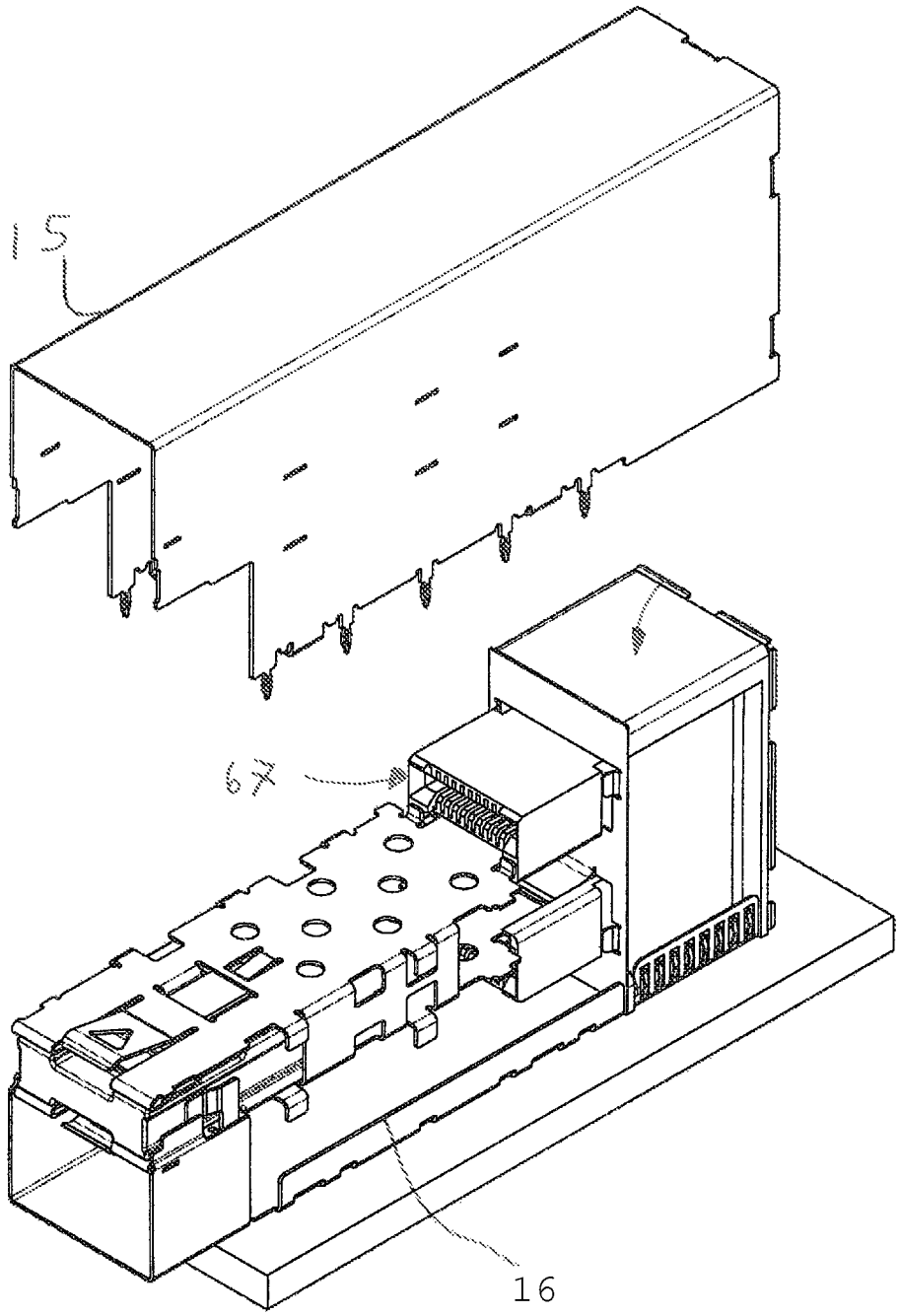
FIG. 3 illustrates a partially exploded perspective view of the embodiment depicted in FIG. 1.
Figure 4:
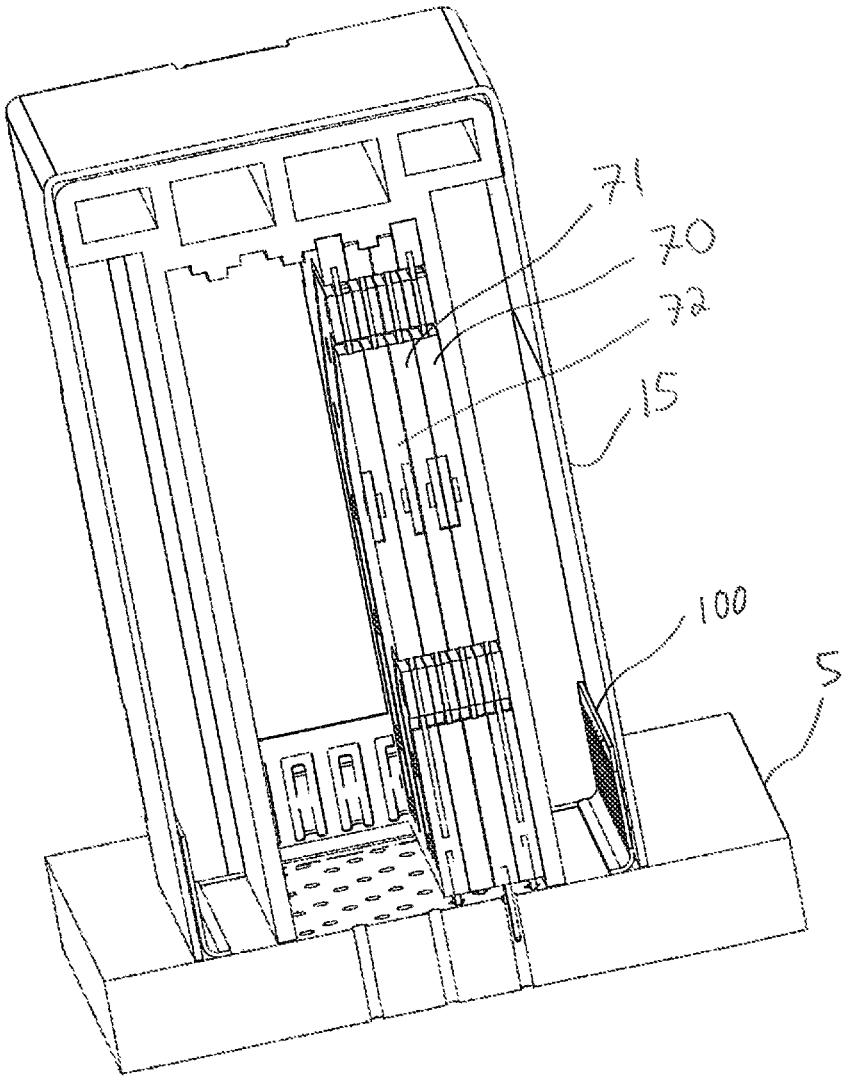
FIG. 4 illustrates a perspective view of a simplified cross-section taken along the line 4-4 in FIG. 1.
Figure 5:
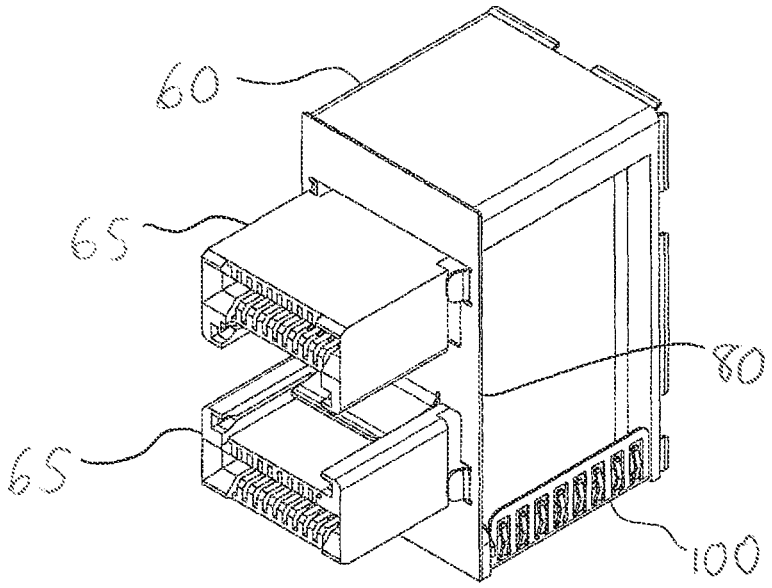
FIG. 5 illustrates a perspective view of an embodiment of a housing and a vertical wall.
Figure 6:
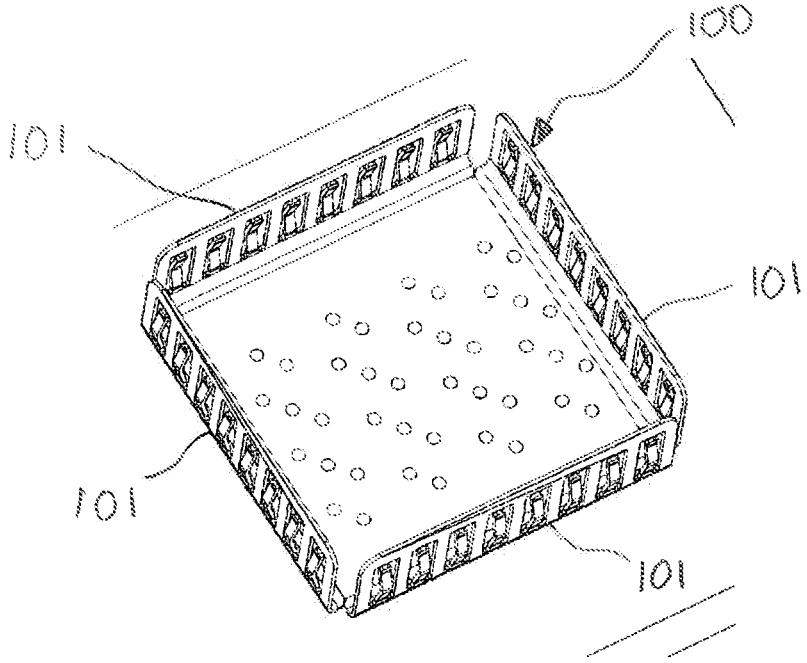
FIG. 6 illustrates a perspective view of an embodiment a vertical wall.
Figure 7:
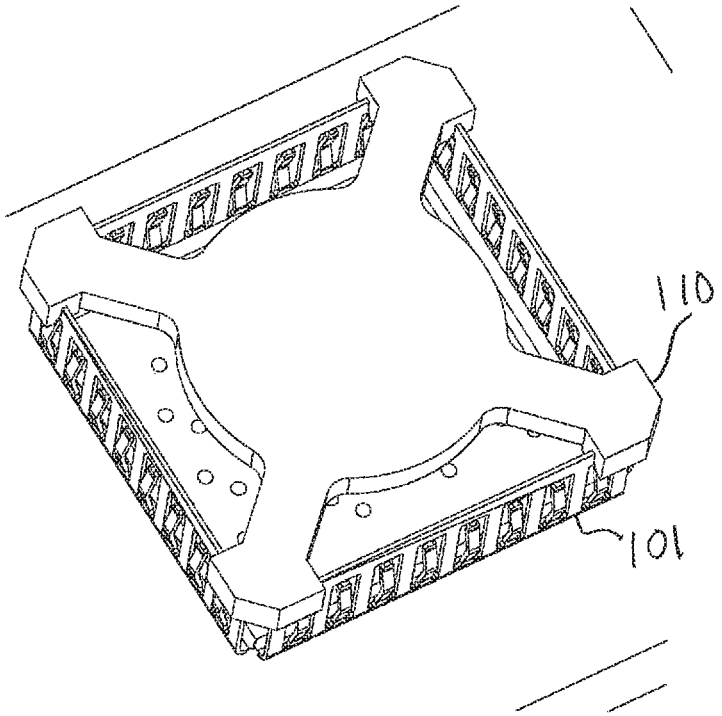
FIG. 7 illustrates a perspective view of an embodiment of a holder and a vertical wall.
Figure 8:
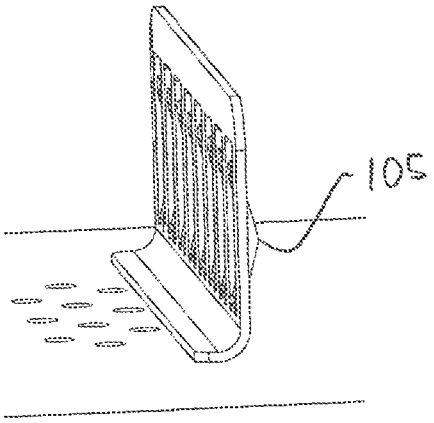
FIG. 8 illustrates a perspective view of an embodiment of a vertical wall mounted on a printed circuit board.
Figure 9:
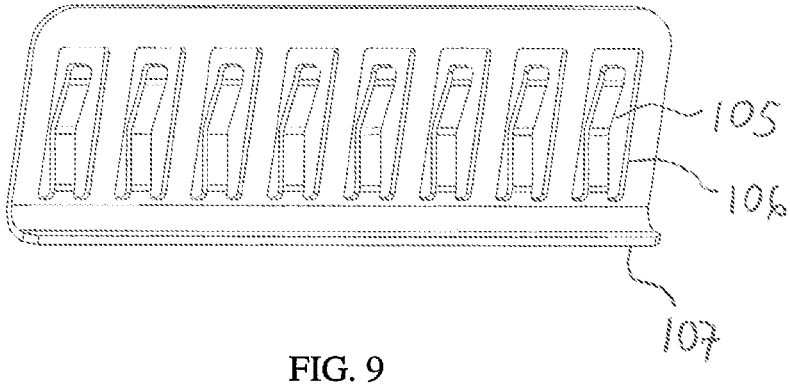
FIG. 9 illustrates a perspective view of the vertical wall depicted in FIG. 8.
Figure 10:
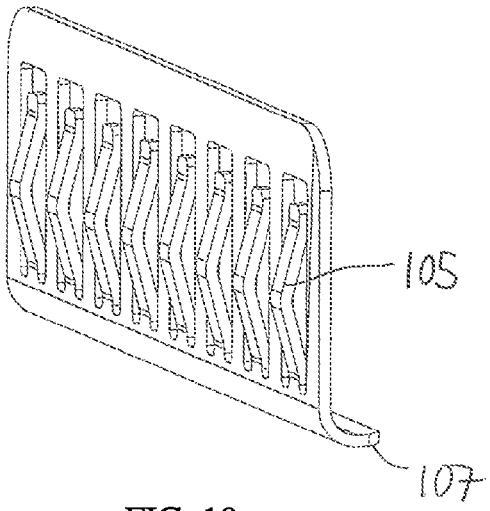
FIG. 10 illustrates another perspective view of the vertical wall depicted in FIG. 8.
Figure 11:
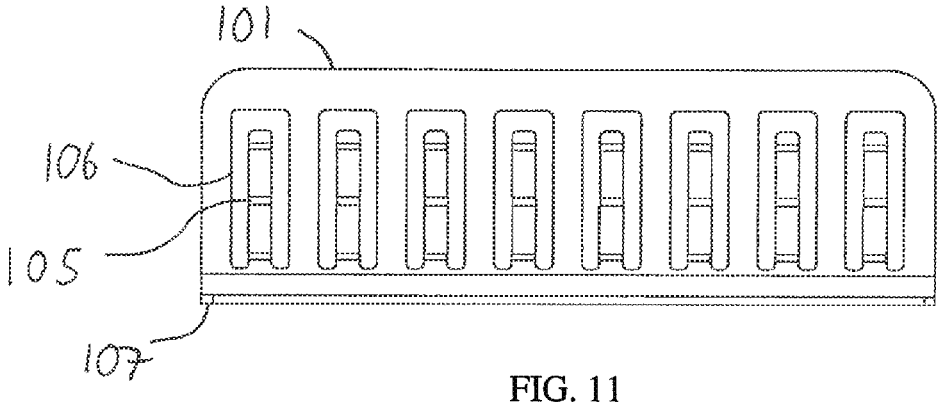
FIG. 11 illustrates an elevated front view of the vertical wall depicted in FIG. 8.

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

It should be noted that certain external connectors have included a cage that used fingers that were configured to be pressed into a circuit board so that there was a good electrical connection between the cage and a ground plane positioned in the circuit board. While the fingers provide acceptable shielding/grounding performance, it has been determined that the fingers, which are positioned in plated vias in the circuit board, inhibit routing of signal traces from the signal terminals provided in the connector, particularly if the fingers are provided as frequently as is desired to ensure good shielding and EMI performance. This issue has been determined to be even worse at higher signaling frequencies because there is a desire to increasingly space the fingers closer together. Thus, it has been determined that an improved grounding solution would be beneficial to address this issue.

FIGS. 1-11 illustrate features that can be used with a connector 10 so as to provide a good electrical connection between a shield 15 and to a ground plane in a printed circuit board 5 (the circuit board may be formed in a manner similar to how conventional printed circuit boards are formed). As depicted, the connector 10 includes a first port 21*a* and a second port 21*b*. The connector 10 includes a conventional shield 15 (that includes a floor 16) which is configured to be pressed into the supporting printed circuit board 5. As is known, this allows the shield 15 to be electrically connected to a ground plane (not shown for purposes of brevity) provided in the printed circuit board 5.

The connector 10 includes a u-brace 40 that helps to define the two ports. A plug 50 can be positioned in a front portion of the u-brace 40. A housing 60 is positioned in the shield 15 and includes projections 65 that are aligned with the two ports 21*a*, 21*b*. As can be appreciated, each projection can include one or more card slots 67. The housing 60 can support a plurality of wafers 70, 71, 72. This can be appreciated from FIG. 4, the shield 15 engages a vertical wall 100. As the vertical wall 100 is electrically coupled to a ground plane provided in the printed circuit board 5, the vertical wall 100 helps ensure a consistent shield extends around the housing 60. As can be appreciated, the vertical wall 100 includes a plurality of fingers 105 that regularly engage the shield 15. This ensures that the gap between points of contact between the vertical wall 100 and the shield 15 is less than a desired maximum distance. Controlling the gap allows one to define the size of a potential opening that could allow EMI to radiate from the connector 10.

Figure 12:
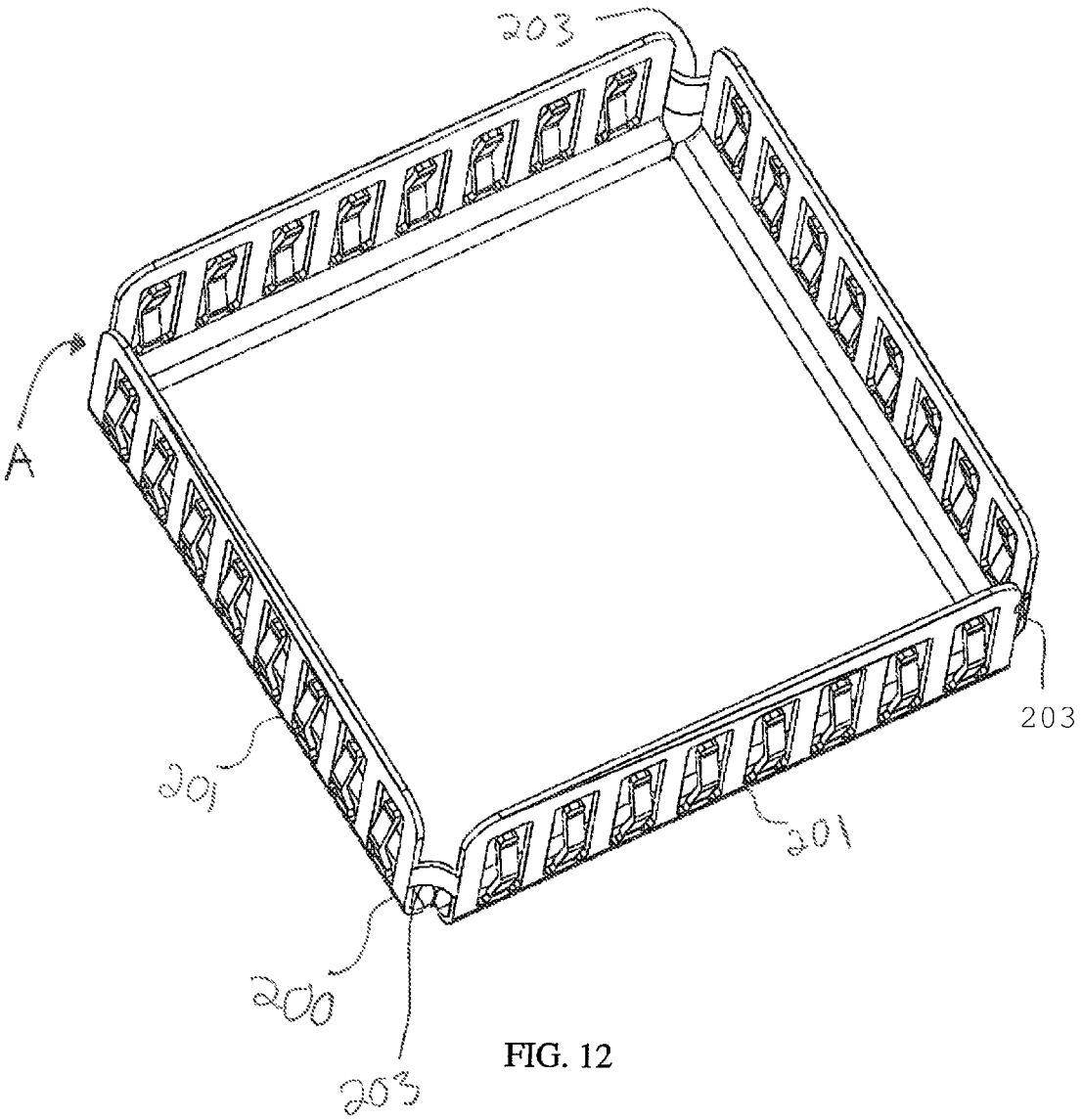
FIG. 12 illustrates a perspective view of an embodiment of a vertical wall assembly.

As depicted, a front wall 80 is included and the front wall 80 helps prevent EMI from radiating into the ports 21*a*, 21*b*. The front wall 80 can also be electrically connected to the vertical wall 100. As can be appreciated, therefore, the vertical wall 100 can include four sides 101 the defined a rectangular area. It should be noted, however, that the vertical wall 100 could omit a side facing the port 21*b*, 21*b* openings. If the four sides 101 used and are separate pieces, a holder 110 can be used to support the sides 101 while they are being soldered to a circuit board. As can be appreciated, sides 201 could also be coupled together by a bridge 203. In an embodiment, for example, the vertical wall could be a single piece with one opening at location A (as illustrated in FIG. 12).

In general, therefore, a vertical wall is positioned on the circuit board and attached to a ground plane in the circuit board (e.g., using surface mount technology or SMT to attach the vertical wall to the ground plane) so that lip 107 is securely and substantially continuously coupled to the circuit board. The coupling electrically connects the vertical wall to the ground plane while providing support for the vertical wall. Consequentially, the vertical wall is positioned adjacent an insulative housing that is position in the cage and engages at least three walls of the cage when the cage is installed.

This can be appreciated, if the vertical wall 100 includes a plurality of separate components that are each separately coupled to the circuit board, a holder 110 may be provided that supports each of the separate components during the fastening process. However, if the vertical wall 100 is a single component then the shape of the structure will help ensure the vertical wall 100 remains upright during the attachment process.

As can be appreciated, the vertical wall 100 extends in a first direction (as depicted, orthogonal to a plane defined by a top surface of the circuit board). Fingers 105, which are flexible, are positioned at some predetermined frequency (e.g., at least every other 2.0 mm or 1.5 mm) which may be fixed or vary as desired. Thus, in an embodiment the fingers can be spaced apart at a 1.5 mm pitch. Decreasing the pitch will intend to increase the frequency at which the connector 10 is effective at managing EMI. The fingers 105 can be cut out of apertures 106 and are configured to engage a cage mounted over the housing 60. When the cage engages the vertical wall 100, the fingers 105 are deflected in a direction that is transverse to the direction the vertical wall extends. Thus, the vertical wall 100 extends in a first direction and the fingers 105 are deflected in a second direction and the second direction may be orthogonal to the first direction. If the vertical wall 100 is configured so as to include the orthogonal relationship, the configuration helps ensure a good electrical connection between the fingers 105 and the corresponding walls of the cage while the finger geometry can be adjusted to help address and account for tolerance in the shape and position of the cage.

In an embodiment, the vertical wall 100 can be positioned in a notch in the housing so as to minimize the required space. Depending on the design of the vertical wall and the housing 60, sufficient space may be maintained between the vertical wall and the housing to support light pipes. Thus, the depicted embodiments can provide for high performance connector while also allowing for a feature-rich connector system.

One benefit of the depicted system is that a reliable intellectual connection can be made between the shield 15 and a corresponding ground plane in the printed circuit board 5 without the need to have tails from the shield 15 extending into the printed circuit board 5. This has the benefit of providing greater flexibility for route out of traces that extend from the terminals provided by the connector 10 while still providing desirable EMI performance.

It should be noted that while the depicted connector 10 is a stacked connector (e.g., has two ports in a vertical alignment), the vertical wall could also be used with a single port connector. In addition, the vertical wall could also be used with a ganged connector (e.g., a 1×2 or a 1×4 or a 2×8).

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

We claim:

1. A connector system for electrically coupling to a ground plane on a circuit board, the system comprising:

a printed circuit board;

a housing with at least one card slot mounted on the printed circuit board, the housing supporting a plurality of terminals that extend from the at least one card slot to the circuit board;

a vertical wall positioned on three sides of the housing and extending in a first direction away from the printed circuit board, the vertical wall including fingers at a predetermined interval, the vertical wall, in operation, coupled to a ground plane of the printed circuit board; and a cage mounted on the circuit board and providing at least one port aligned with the at least one card slot, the cage engaging the fingers so as to cause the fingers to deflect in a second direction.

2. The connector of claim 1, wherein the fingers are at a pitch of not more than 2.0 mm.

3. The connector of claim 1, further comprising a front wall positioned on a front side of the housing, the front wall extending on two opposing sides of the at least one card slot.

4. The connector of claim 1, wherein the vertical wall is a one-piece structure.

5. The connector of claim 4, further comprising a front wall positioned on a front side of the housing.

6. The connector of claim 5, wherein the vertical wall is positioned on four sides of the housing.

7. A connector system, comprising:

a housing with a mating face and a mounting face, the mating face having a card slot with a first and second side and the mounting face configured to be mounted on a circuit board, the housing supporting a plurality of terminals that have contacts positioned in the first and second sides of the card slot;

a cage positioned around the housing, the cage including a back wall, a top wall and two side walls and defining a port that is aligned with the card slot; and a front wall extending along the mating face, the front wall extending on both the first and second sides of the card slot, the front wall configured to be electrically coupled to the cage and configured to help prevent electromagnetic interference (EMI) from radiating into the port; and a vertical wall configured to be positioned on at least three sides of the housing, the vertical wall configured to be electrically coupled to the cage and further configured, in operation, to be electrically coupled to a ground plane on a supporting circuit board.

8. The connector system of claim 7, wherein the front wall is configured to be electrically coupled to the vertical wall.

9. The connector system of claim 7, wherein the card slot is configured to extend past the front wall into the port.

10. The connector system of claim 7, wherein the card slot is a first card slot and the housing further includes a second card slot, the first and second card slots being spaced apart.

11. The connector system of claim 10, wherein the port is a first port, the cage further defining a second port, the first port aligned with the first card slot and the second port aligned with the second card slot.

12. The connector system of claim 11, wherein the front wall extends along the mating face on both sides of the first and second card slots.

* * * * *